US009652954B2

(12) United States Patent
Piccoli et al.

(10) Patent No.: US 9,652,954 B2
(45) Date of Patent: May 16, 2017

(54) INTEGRATED LOCK AND PIN SECURITY TAG

(71) Applicant: Checkpoint Systems, Inc., Thorofare, NJ (US)

(72) Inventors: Anthony F. Piccoli, West Deptford, NJ (US); Wei Wu, Shanghai (CN); Seth Strauser, Mullica Hill, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 9 days.

(21) Appl. No.: 14/643,214

(22) Filed: Mar. 10, 2015

(65) Prior Publication Data

US 2015/0262463 A1 Sep. 17, 2015

Related U.S. Application Data

(60) Provisional application No. 61/951,339, filed on Mar. 11, 2014.

(51) Int. Cl.

| | |
|---|---|
| ***G08B 13/14*** | (2006.01) |
| ***G08B 13/24*** | (2006.01) |
| ***E05B 73/00*** | (2006.01) |

(52) U.S. Cl.

CPC ..... *G08B 13/2434* (2013.01); *E05B 73/0017* (2013.01); *G08B 13/1445* (2013.01); *G08B 13/1463* (2013.01); *G08B 13/2417* (2013.01); *G08B 13/2437* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,403,227 | B2 * | 3/2013 | Day | E05B 73/0017 235/484 |
| 2009/0278691 | A1 * | 11/2009 | Valade | E05B 73/0017 340/572.8 |
| 2010/0287998 | A1 * | 11/2010 | Anderson | E05B 73/0017 70/57.1 |
| 2012/0204608 | A1 * | 8/2012 | Sayegh | E05B 73/0017 70/19 |

FOREIGN PATENT DOCUMENTS

| | | | |
|---|---|---|---|
| WO | 2006127674 | A1 | 11/2006 |

OTHER PUBLICATIONS

Extended European Search Report and Written Opinion of corresponding European Application No. 15158481.0 mailed on Aug. 13, 2015.

* cited by examiner

*Primary Examiner* — Travis Hunnings
(74) *Attorney, Agent, or Firm* — Nelson Mullins Riley & Scarborough, LLP

(57) ABSTRACT

A security tag may include a pin cover, a pin housing, a receiving gap disposed between the pin cover and the pin housing, a pin configured to engage an article placed within the receiving gap, and a biasing member configured to actuate the pin by urging the pin toward the pin cover in response to the article being substantially placed within the receiving gap.

18 Claims, 11 Drawing Sheets

FIG. 8C
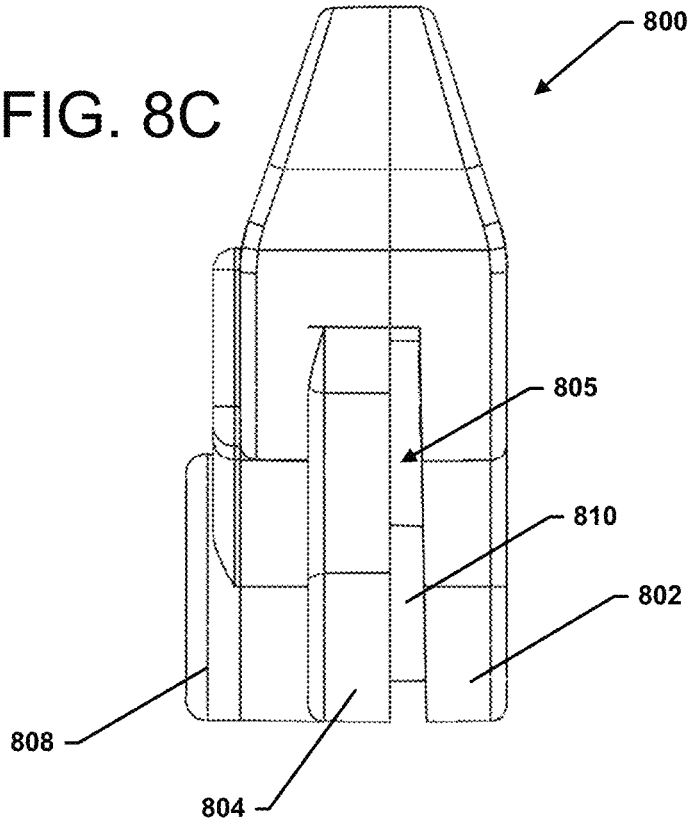
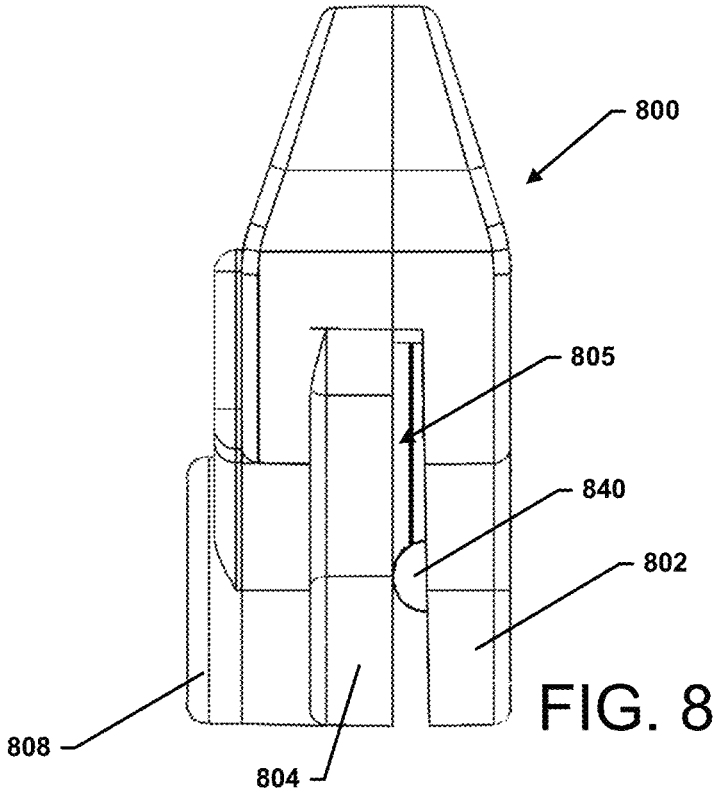
FIG. 8D

INTEGRATED LOCK AND PIN SECURITY TAG

CROSS-REFERENCE TO RELATED APPLICATIONS

This application claims the benefit of U.S. Provisional Application No. 61/951,339 filed on Mar. 11, 2014, the entire contents of which are hereby incorporated herein by reference.

TECHNICAL FIELD

Various example embodiments relate generally to security tags and, more particularly, to a device including a self-contained lock and pin, and a method for attaching the device to an article for protection and/or inventor management purposes.

BACKGROUND

Electronic article surveillance (EAS) includes the tracking and/or detecting the presence or removal of items from warehousing, inventory, or a retail establishment. EAS is achieved by applying an EAS element as part of a security tag to the item or its packaging and when the security tags are exposed to a predetermined electromagnetic field (e.g. pedestals located at a retail establishment exit), they activate to provide some type of alert and/or supply data to a receiver or other detector. In the electronic article surveillance (EAS) industry, a "hard tag" refers to either a re-usable or disposable tag which is intended to be removed from an article, e.g., merchandise at the point of sale to be re-used on other merchandise or thrown away. Hard tags typically are constructed to contain an EAS element, which may be for example an acousto-magnetic element (AM), a radio frequency element (RF), or electro-magnetic element (EM). Tags may also be constructed to contain a radio frequency identification (RFID) element, which may respond at low, high, or ultra-high frequencies.

An EAS element may include a resonant circuit with a coil coupled to a capacitor. The EAS security element is tuned to a predetermined frequency and if one attempts to remove the hard tag with the security element from a store, an alarm triggers as the tag passes through a surveillance field created by a transmitter and receiver located between pedestals at the store exit, tuned to the same frequency. The alarm goes off as the EAS element resonates, providing an output signal detected by a receiver, also located in the pedestals.

An RFID element typically includes an integrated circuit (IC) and an RF LC circuit (resonant circuit) or antenna (e.g. a dipole antenna), tuned to a predetermined RF frequency. Often, the integrated circuit (IC) comprises memory that has been programmed with information associated with the article (e.g., product ID information such as a serial number, unique identification number, price, etc.). When a transmitter emits a signal at the predetermined RF frequency and threshold value which is received by the tuned antenna, the RFID element emits a signal containing the stored information which is then received by a receiver and the information demodulated from the element-emitted signal. This information can then be used for, among other things, determining whether to set off an alarm or not. The RFID tag may also be used for merchandise visibility and inventory control, to identify where a tag and associated product are located or where they have moved to or from within the store.

As an alternative to an EAS element embedded in a hard tag, the hard tag may be equipped with a benefit denial device. A benefit denial tag typically includes ink releasing elements, such that when an attempt to break the tag from a product is performed, glass vials of ink shatter within the tag, ultimately leaking about the product which devalues the product and likewise to provide notification to the retailer that that particular merchandise was tampered with.

BRIEF SUMMARY OF SOME EXAMPLES

Accordingly, some example embodiments may provide devices for improving the capability for securing products. In one example embodiment, a security tag is provided. The security tag may include a pin cover, a pin housing, a receiving gap disposed between the pin cover and the pin housing, a pin configured to engage an article placed within the receiving gap, and a biasing member configured to actuate the pin by urging the pin toward the pin cover in response to the article being substantially placed within the receiving gap.

In another example embodiment, a lock and pin mechanism for transferring a security tag between a locked state in which the security tag is affixed to an article and an unlocked state in which the security tag is not affixed to the article is provided. The lock and pin mechanism may include a pin and a biasing member. The pin may be substantially retained in a pin housing. The pin may be configured to advance to the locked state by moving toward a pin cover separated from the pin housing by a receiving gap disposed between the pin cover and the pin housing. The pin may be configured to engage the article responsive to placement of the article within the receiving gap. The biasing member may be configured to actuate the pin by urging the pin toward the pin cover in response to the article being substantially placed within the receiving gap.

BRIEF DESCRIPTION OF THE SEVERAL VIEWS OF THE DRAWING(S)

Having thus described some embodiments in general terms, reference will now be made to the accompanying drawings, which are not necessarily drawn to scale, and wherein:

FIG. 8C is a side view of the security tag in the locked state in accordance with an example embodiment;

FIG. 8D is a side view of the security tag in the unlocked state in accordance with an example embodiment.

DETAILED DESCRIPTION

Figure 1A:
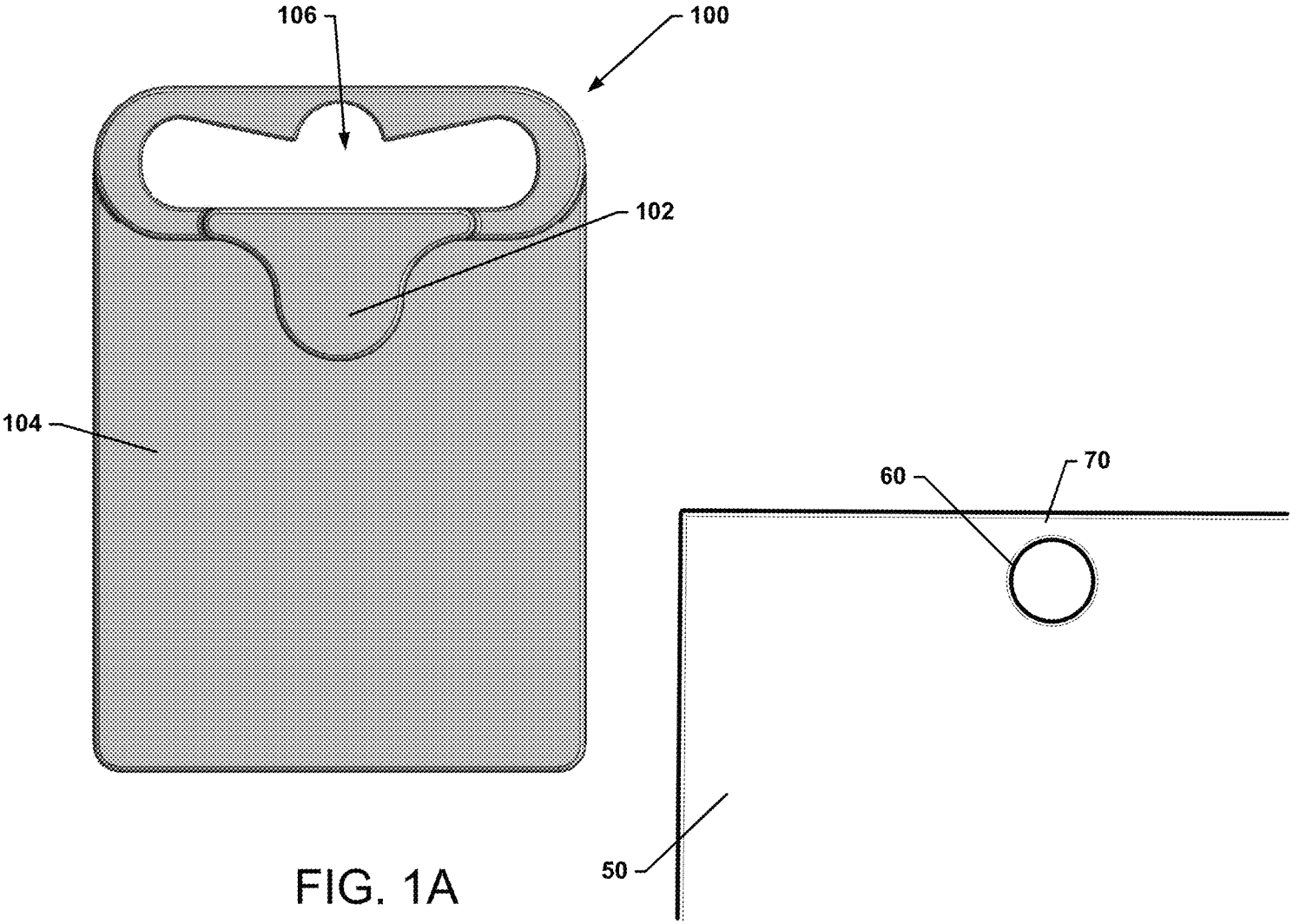
FIG. 1A illustrates a front facing view of a security tag which includes an integrated lock and pin in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

FIG. 1A depicts an integrated lock and pin security tag 100, according to an example embodiment. The security tag 100 may be affixed to an article 50 for protection or inventory management of the article 50. The article 50 may be a retail item, packaging for a retail item, or any other enclosure, accessory, or portion of a retail item or other object for which protection or inventory management may be desirable. In an example embodiment, the article 50 may include an orifice 60 disposed at a portion thereof. The orifice 60 may be provided for hanging the article 50, or may otherwise be any opening provided at any portion of the article 50 that provides a catch portion 70 to which the security tag 100 can be attached.

Of note, the orifice 60 of FIG. 1A is circular, but any shape could suffice in various example embodiments. All that is required is that at least a portion of the article 50 be available for interaction with the security tag 100 as the catch portion 70, regardless of how the catch portion 70 is formed or how the catch portion 70 is shaped. Thus, the security tag 100 may be attached to the article 50 via the orifice 60 and the catch portion 70 as described in greater detail below.

In one example, the security tag 100 may include an aperture 106 for hanging of the security tag 100 and the article 50 together as a unit. In this regard, if the orifice 60 is generally intended as a receiver for a hook or other protrusion by which to hang or display the article 50, the attachment of the security tag 100 may otherwise prevent hanging or display in such a manner. Accordingly, the aperture 106 may provide an alternate structure by which to hang or display the unit formed when the security tag 100 is affixed or otherwise attached to the article 50.

In some embodiments, the security tag 100 may be formed entirely, or in part, of a solid material. As such, all or portions of the security tag 100 may be formed from molded plastic or other rigid materials. In an example embodiment, the security tag 100 may include a lock and pin cover 102. The lock and pin cover 102 may cover a lock and pin mechanism (see FIG. 2) for attaching the security tag 100 to the article 50 via connection with the orifice 60 and the catch portion 70. The pin cover 102 may be made of hard plastic, or any other material that provides protection to the lock and pin mechanism located below the pin cover 102. In the embodiment shown in FIG. 1A, the pin cover 102 is shaped in a curved manner. However, the pin cover 102 may be shaped in many and various configurations, including shaped in a straight line, jagged line, etc. Further, the pin cover 102 may be configured in a combination of shapes and other configurations. Further, the pin cover 102 may be larger, or smaller, than the pin cover 102 shown on FIG. 1A.

The security tag 100 may further include a tag housing 104. The tag housing 104 may include one or more information elements, e.g., an RFID, RF, AM, and/or EM element. The tag housing 104 may be made of any hard material that protects the security tag 100 from breakage. In some examples, the tag housing 104 may be made of hard plastic, nylon, etc. Further, the tag housing 104 may be configured to align with the article 50 for attachment. As such, for example, the tag housing 104 may be flat (as depicted in FIG. 1A) to align with a flat portion or surface of the article 50. In other embodiments, however, the tag housing 104 may be curved, may include one or more apertures, etc. The tag housing 104 may also be sized so that it is fixedly attachable to a portion of the article 50 (e.g., the catch portion 70). In this example, the tag housing 104 may be sized small so that it is attachable to a small article. However, in other cases, the tag housing 104 may be sized at a grand scale to attach to a larger article. In other examples, the tag housing 104 may be sized irrespective of the article to which it will attach.

Figure 1B:
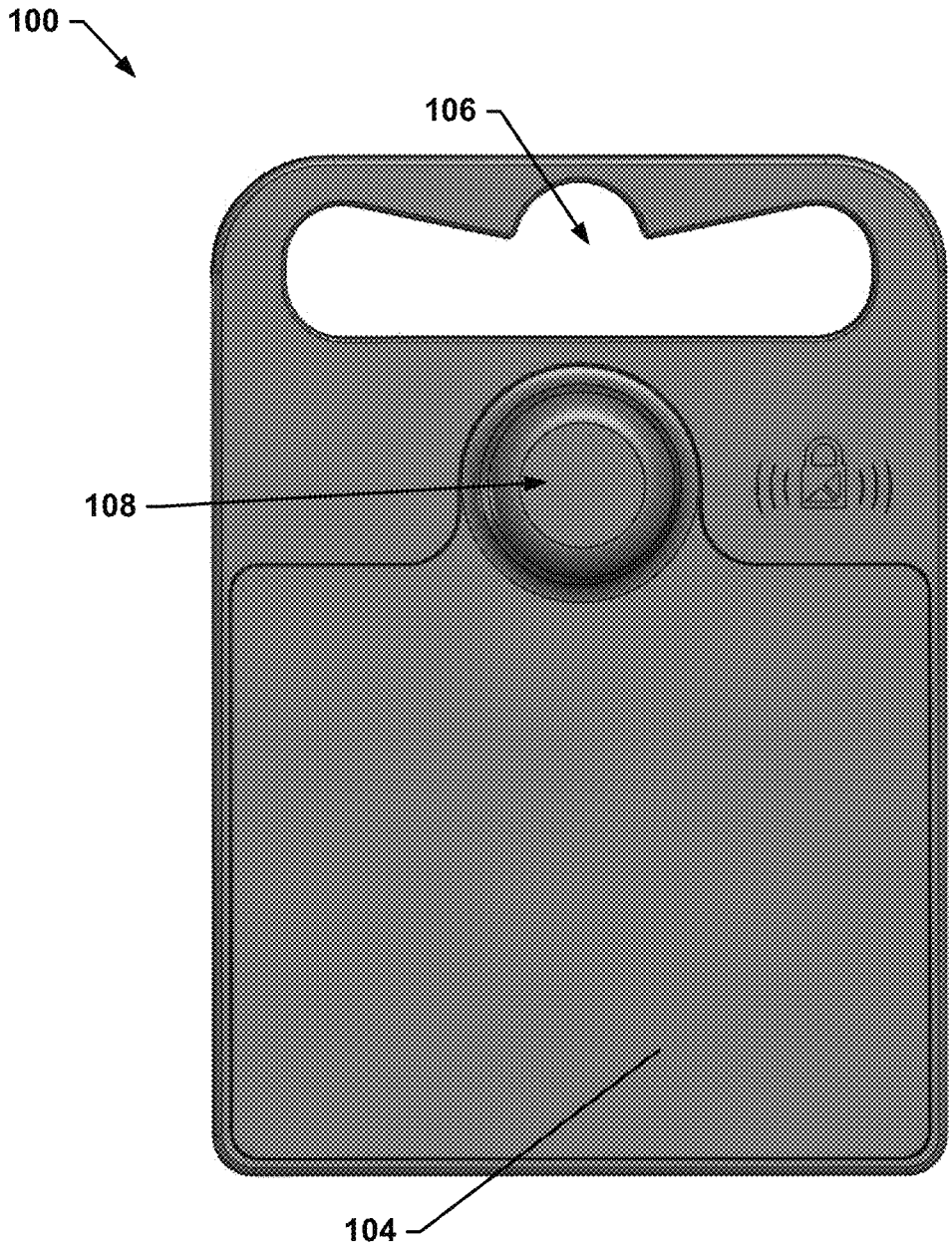
FIG. 1B illustrates a rear facing view of the security tag depicted in FIG. 1A in accordance with an example embodiment.

FIG. 1B depicts a rear view of the security tag 100 depicted in FIG. 1A. FIG. 1B shows the tag housing 104 and aperture 106, as shown in FIG. 1A. FIG. 1B also depicts lock and pin housing 108. Lock and pin housing 108 may house some or all of the components of the lock and pin mechanism (FIG. 2), which is used to affix the security tag 100 to the article 50. The lock and pin housing 108 may be made of the same, or different, materials as the materials from which the tag housing 104 and the pin cover 102 are made. As best seen in FIG. 3, for example, the lock and pin housing 108 may be configured or otherwise have an external shape that resembles a cylinder. The lock and pin housing 108, however, may be configured in many and various other shapes (e.g., as a rectangle, square, etc.). Moreover, although not required, in some cases, the shape of the lock and pin housing 108 may correspond to the shape of the pin housed therein.

Figure 2:
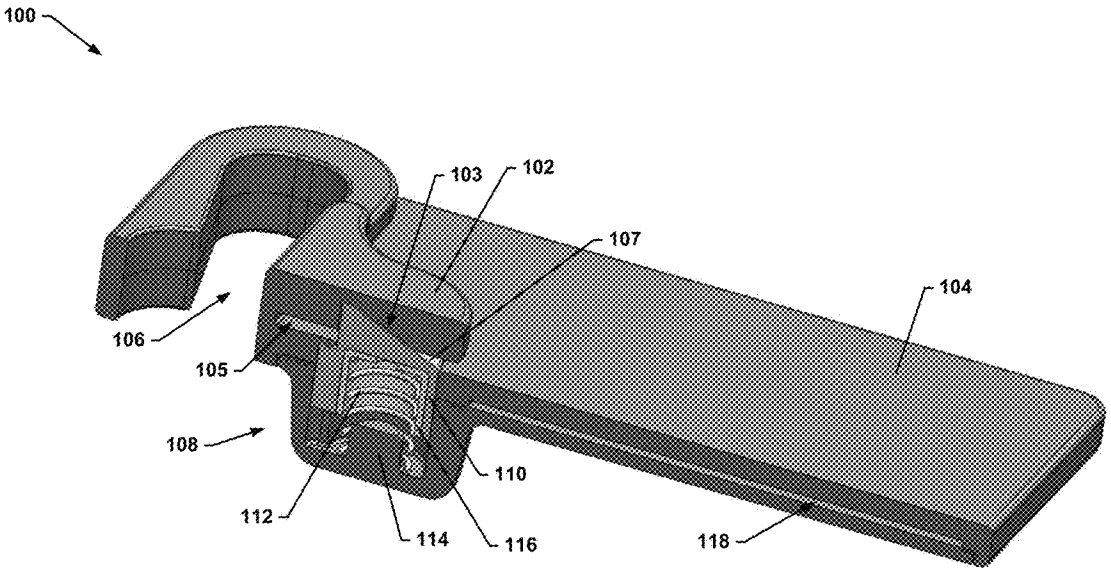
FIG. 2 illustrates a sectional perspective view of the security tag of FIG. 1A in accordance with an example embodiment.
Figure 3:
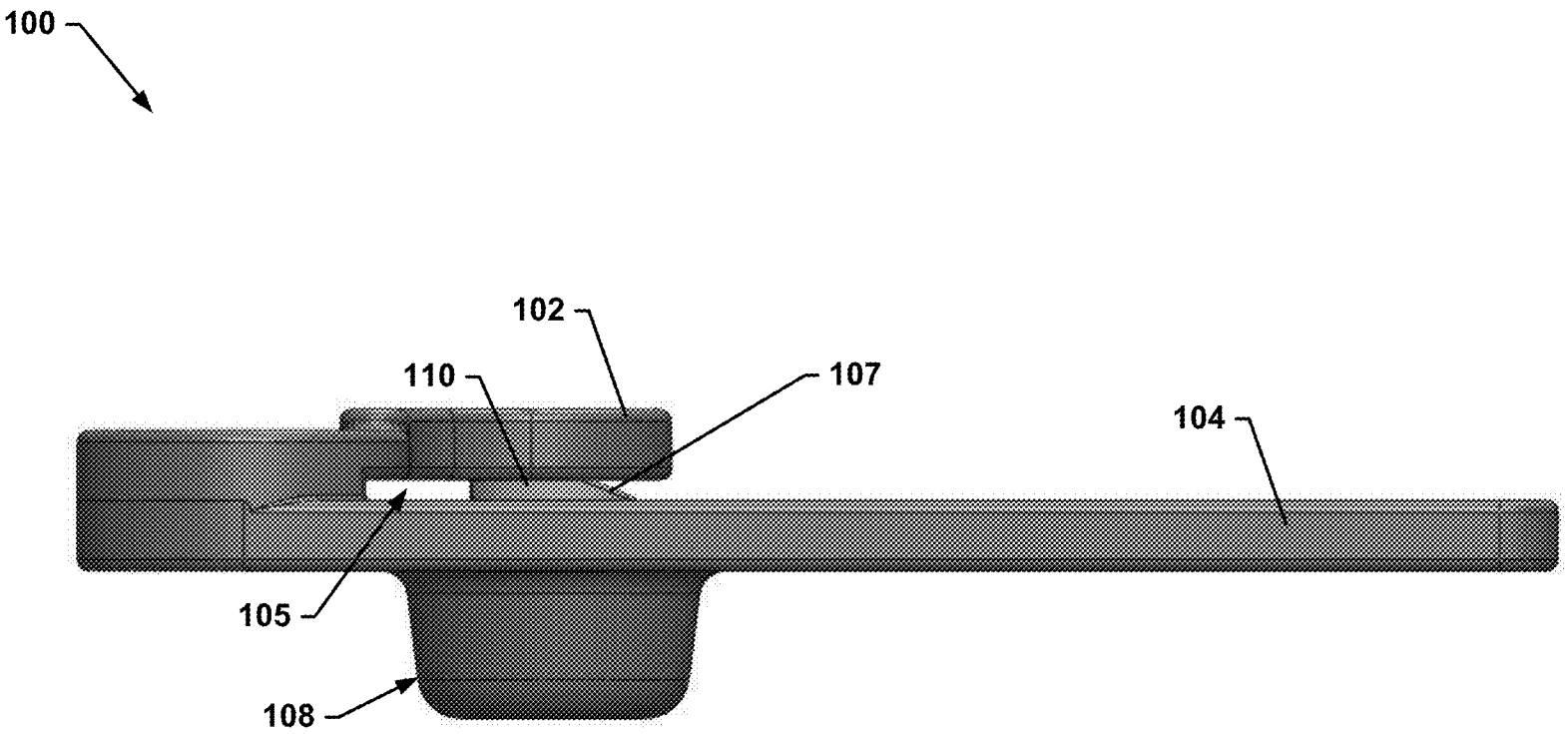
FIG. 3 illustrates a side view of the security tag depicted in FIG. 1A in accordance with an example embodiment.

FIG. 2 illustrates an exploded sectional view of the security tag 100 in accordance with an example embodiment. FIG. 3 shows a side view of the security tag 100. The security tag 100 includes the aperture 106 for hanging the tag 100 and any article to which the security tag 100 is attached. The security tag 100 also includes the pin cover 102 and the lock and pin housing 108, as described above. The lock and pin housing 108 includes the lock and pin mechanism that is used to affix the security tag 100 to the article 50. The lock and pin mechanism, in some embodiments, includes a pin 110 and a biasing member that may be employed to bias the pin 110 to a locked state responsive to actuation or triggering of the pin 100 by contact between a trigger element and the catch portion 70 of the article 50. The tag cover 102 may be on an opposite side of the tag housing 104 relative to a side of the tag housing 104 on which the lock and pin housing 108 is located. Moreover, while the lock and pin housing 108 may generally extend away from a first flat surface of the tag housing 104, at least a portion of the pin cover 102 may be spaced apart from a second and opposite flat surface of the tag housing 104. The space between the pin cover 102 and the second flat surface of the tag housing 104 may be referred to as a catch portion receiving gap 105.

In the example of FIGS. 1A, 1B, 2 and 3, the biasing member comprises a spring 112 that employs a spring force to urge the pin 110 toward a pin receiver 103 disposed in the tag cover 102. The pin receiver 103 may be a gap, aperture, orifice, cavity or other such receptacle that is positioned, shaped or otherwise capable of receiving the pin 110 when the biasing member urges the pin 110 toward the locked state. As such, the pin receiver 103 is formed in a surface of the tag cover 102 that faces the tag housing 104 and is therefore generally not visible external to the security tag 100.

In an example embodiment, a trigger element 107 may be provided in the catch portion receiving gap 105 to engage the catch portion 70 of the article 50 responsive to insertion of the catch portion 70 into the catch portion receiving gap 105. The catch portion 70 may exert a force on the trigger element 107 to trigger the pin 110 to move toward the locked state when the orifice 60 is substantially aligned with the pin 110 so that the pin 110 can pass through the orifice 60 into the pin receiver 103. In the specific example of FIGS. 1A, 1B, 2 and 3, the trigger element 107 may be a top surface of the pin 110. In this regard, for example, the trigger element 107 may be formed such that the top surface of the pin 110 is sloped toward the tag housing 104 with the slope generally decreasing linearly facing away from the catch portion receiving gap 105. However, in other examples, the trigger element 107 may be a separate component that is operably coupled to the pin 110, or may otherwise be shaped or provided in a different manner.

Accordingly, in connection with the example of FIGS. 1A, 1B, 2 and 3, the catch portion 70 may engage the trigger element 107 to force the pin 110 further into the lock and pin housing 108 against the force of the spring 112. When the orifice 60 is aligned with the pin 110 so that no portion of the catch portion 70 is blocking an advance of the pin 110 toward the pin receiver 103, the pin 110 will be allowed to move responsive to the urging of the spring 112 toward (and into) the pin receiver 103. When the pin 110 is seated in the pin receiver 103, with the catch portion 70 advanced into the catch portion receiving gap 105, the security tag 100 is fixed to the article 50 until the pin 110 is removed from the orifice 60.

In an example embodiment, the spring 112 may generally be housed within the lock and pin housing 108 along with a spring locator 114 and spring cup 116. In some examples, the spring 112 may be contained within the spring cup 116, and around the spring locator 114 (or spring positioned). The spring cup 116, in some embodiments, may be made of metal, plastic, or any other solid material that can be used to hold the spring 112. The spring cup 116 may also be sized and shaped to fit snugly within a portion of the pin 110. However, in other examples, the pin 110 may have a hollow cylindrically shaped center into which the spring 110 may fit so that there is no need to form or employ the spring cup 116 as a separate component. The spring locator 114 may be a protrusion that fits inside the spring 112 (or a portion of the spring 112) to ensure that the spring 112 is not displaced laterally. The spring locator 114, shown on FIG. 2, may also have the shape of a cylinder having an outer diameter about the same as the inner diameter of the spring 112. The spring locator 114, however, may be of any shape for keeping the spring 112 in position.

In an example embodiment, the security tag 100 may also include a recess 118 within the tag housing 104. The recess 118 may be used to receive an information element, such as an RF, AM, EM, or RFID element. In some examples, the recess 118 may be configured to include one or more compartments to receive one or more information elements. In some examples, the recess 118 may be configured to align longitudinally and/or laterally along the tag housing 104. In other examples, the recess 118 may be located within a center of the tag housing 104. Further, the tag housing 104 may be configurable to allow for at least one additional information element. The information element disposed in the recess 118 may trigger an alarm when placed in a surveillance field as described above. However, in one example embodiment, the tag housing 104 may include an attachment mechanism which allows an additional tag housing (see FIG. 9), including information elements, to be added to the tag housing 104.

In an example embodiment, once the pin 110 is enabled to pass through the orifice 60 to capture the catch portion 70 in the catch portion receiving gap 105 to be received in the pin receiver 103, the pin 110 may generally be considered to be in the locked state. In the locked state, the security tag 100 is affixed to the article 50. Generally speaking, the security tag 100 may stay in the locked state until some action is taken to unlock the security tag 100. In an example embodiment, shifting the security take to an unlocked state may be accomplished using a key. In some cases, the key may be magnetic, and may be placed proximate to a distal end of the lock and pin housing 108 to draw the pin 110 out of the pin receiver 103. In this regard, for example, the key may draw a metallic component such as the spring cup 116 and/or the pin 110 (when either or both are metallic) away from the pin receiver 103 against the force of the spring 112. When the pin 110 is drawn substantially clear of the pin receiver 103 and the catch portion receiving gap 105 (e.g., into the lock and pin housing 108), the catch portion 70 may be removed from the security tag 100 and the article 50 may be freed from the security tag 100. In some embodiments, rather than magnetic key, a wireless signal may be communicated to a locking mechanism to position the pin 110 in the locked and unlocked states.

Figure 4:
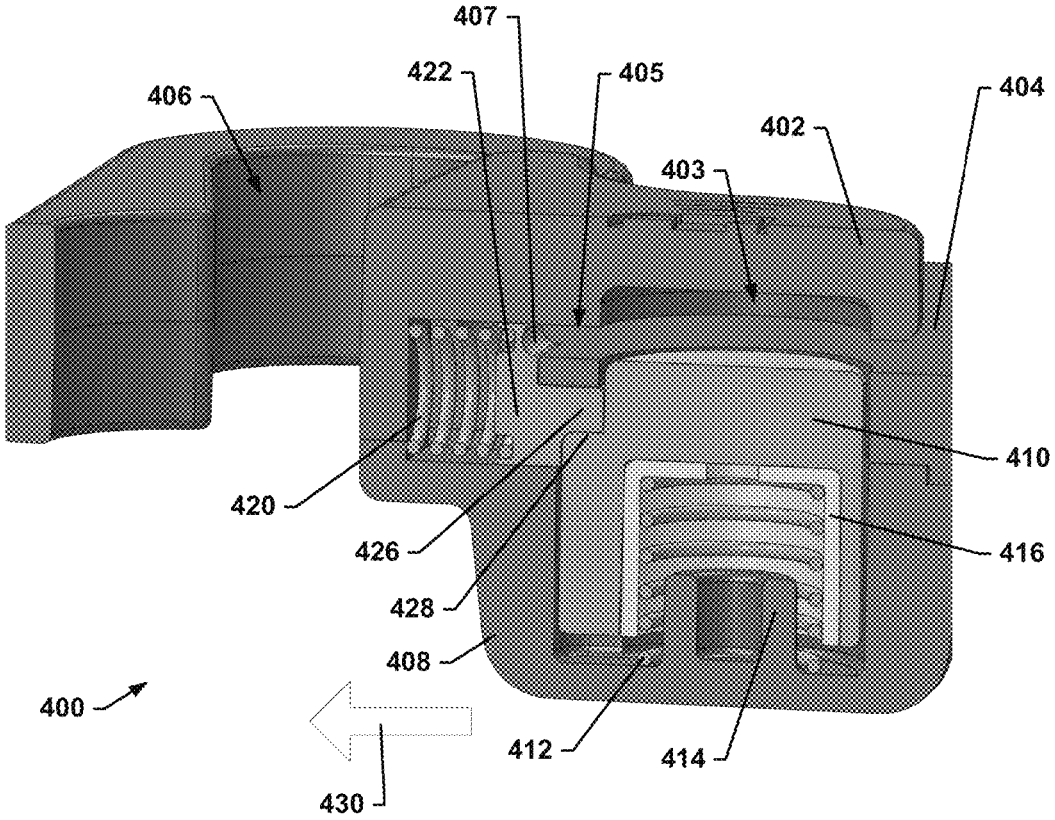
FIG. 4 illustrates a an exploded view of a security tag in accordance with an example embodiment.
Figure 5:
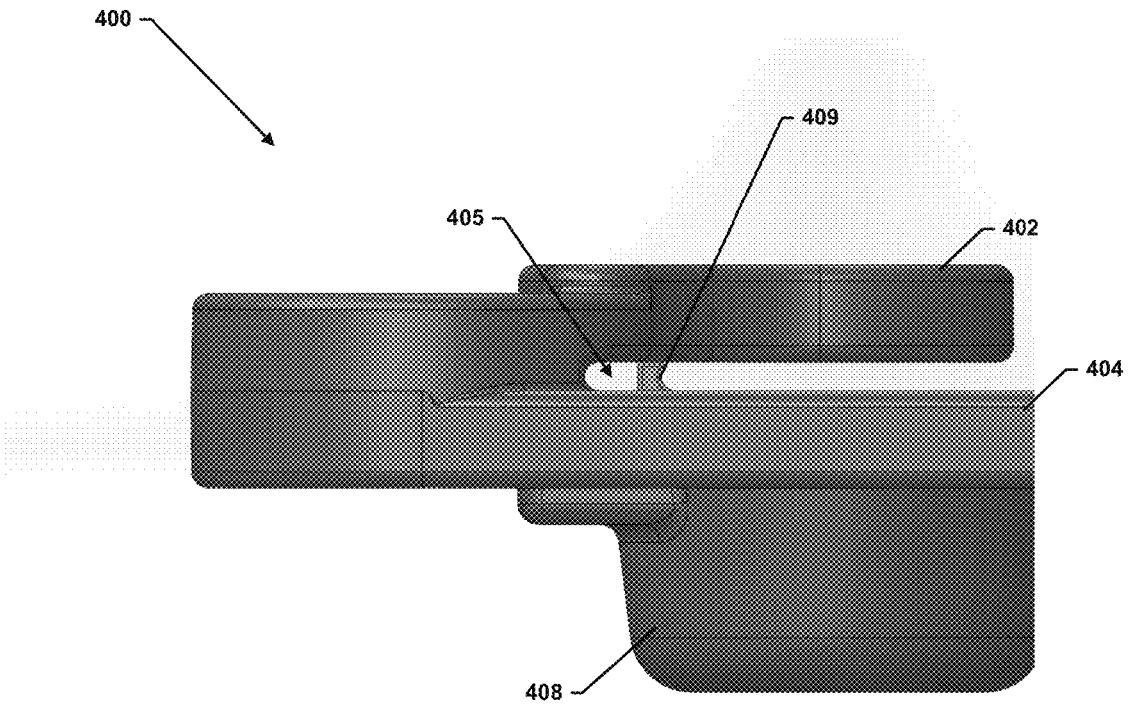
FIG. 5 illustrates a side view of the security tag depicted in FIG. 4 in accordance with an example embodiment.

FIGS. 4 and 5 depict another example embodiment of a security tag 400. FIG. 4 illustrates a partial cross section view of the security tag 400 and FIG. 5 illustrates a side view of the security tag 400. The security tag 400 may be similar to that described in connection with FIGS. 1A, 1B, 2 and 3, except that the structure of the lock and pin mechanism may be somewhat different to illustrate another example embodiment. The security tag 400 of FIGS. 4 and 5 includes an aperture 406, lock and pin cover 402, tag housing 404, lock and pin housing 408, spring cup 416, spring 412, and spring locator 414, which are similar to aperture 106, pin cover 102, tag housing 104, lock and pin housing 108, spring cup 116, spring 112, and spring locator 114, respectively. The security tag 400 includes additional elements in the lock and pin mechanism, including pin 410, actuator 422, and actuator spring 420. As shown on FIG. 4, the top surface of pin 410 is different than the top surface of pin 110 (e.g., the top surface of pin 410 is flat, while the top surface of pin 110 is sloped (see FIG. 2)). Thus, in the example of FIG. 4, the actuator 422 forms the trigger element as a separate component instead of the top surface of the pin 110 and the pin 110 combining to form the trigger element 107, as described above in reference to FIGS. 1A, 1B, 2 and 3.

As shown in FIG. 4, a pin receiver 403 is provided in the pin cover 402, similar to the example above. Additionally, a catch portion receiving gap 405 is provided between the pin cover 402 and a surface of the tag housing 404. When the article 50 is slid into the catch portion receiving gap 405 to contact a trigger element 407 of the actuator 422, the catch portion 70 of the article 50 may engage the trigger element 407 and push the actuator 422 in the direction of arrow 430 against the force of the actuator spring 420, which otherwise biases the actuator 422 in a direction opposite the direction of arrow 430 and toward contact with the pin 410.

A flange 426 may be provided at a portion of the actuator 422 to prevent motion of the pin 410 toward the pin receiver 403 when the security tag 400 is in the unlocked state. In this regard, the flange 426 may contact a retaining edge 428 on a side of the pin 410 to hold the pin 410 substantially out of the catch portion receiving gap 405. However, when the catch portion 70 pushes the trigger element 407 and actuator 422 in the direction of arrow 430 against the force of the actuator spring 420, the flange 426 may be pushed out of contact with the retaining edge 428 and the spring 412 may urge the pin 410 upward. When the orifice 60 is generally aligned with the pin 410, the pin 410 may move through the orifice 60 and into the pin receiver 403 to retain the catch portion 70 in the catch portion receiving gap 405. This shifts the security tag 400 into the locked state. In the locked state, the retaining edge 428 engages the tag housing 404, thereby preventing the flange 426 from reengaging the retaining edge 428. As such, the pin 410 will remain in the locked state responsive to biasing by the spring 412 until a force is applied to overcome the spring force exerted by the spring 412. In some examples, the spring force of the spring 412 may be overcome by a magnetic key or wirelessly triggered unlocking mechanism, as described above. When the pin 410 is withdrawn into the lock and pin housing 408 far enough to allow the flange 426 to reengage the retaining edge 428, the actuator spring 420 may bias the actuator 422 (and the flange 426) in a direction opposite the direction of arrow 430 so that the flange 426 again engages the retaining edge 428 to hold the pin 410 in the unlocked state. The catch portion 70 can then be removed from the catch portion receiving gap 405 and the security tag 400 is thereby removed from the article 50.

As can be appreciated from the examples of FIGS. 1-5 above, the lock and pin mechanism can be embodied a number of different ways, and with corresponding different structures. However, generally speaking, the lock and pin mechanism may include a pin that transitions between an unlocked state (in which the article 50 can be brought into contact with a portion of the security tag) and a locked state (in which the article 50 is affixed to the security tag) based on the article contacting a trigger element that shifts the lock and pin mechanism from the unlocked state to the locked state. As such, contact between the article 50 (e.g., the catch portion 70) and the trigger element enables the security tag to shift to the locked state. The actual shift to the locked state may further require alignment of the orifice 60 on the article 50 with the pin so that the pin can transit through the orifice 60 to retain the catch portion 70. To further illustrate the different structures that can embody the lock and pin mechanism, FIGS. 6 and 7 will now be described. In this regard, FIG. 6 illustrates a top view of a security tag 600 of another example embodiment, and FIG. 7 illustrates a cross sectional view taken along the longitudinal centerline of the security tag 600.

Figure 6:
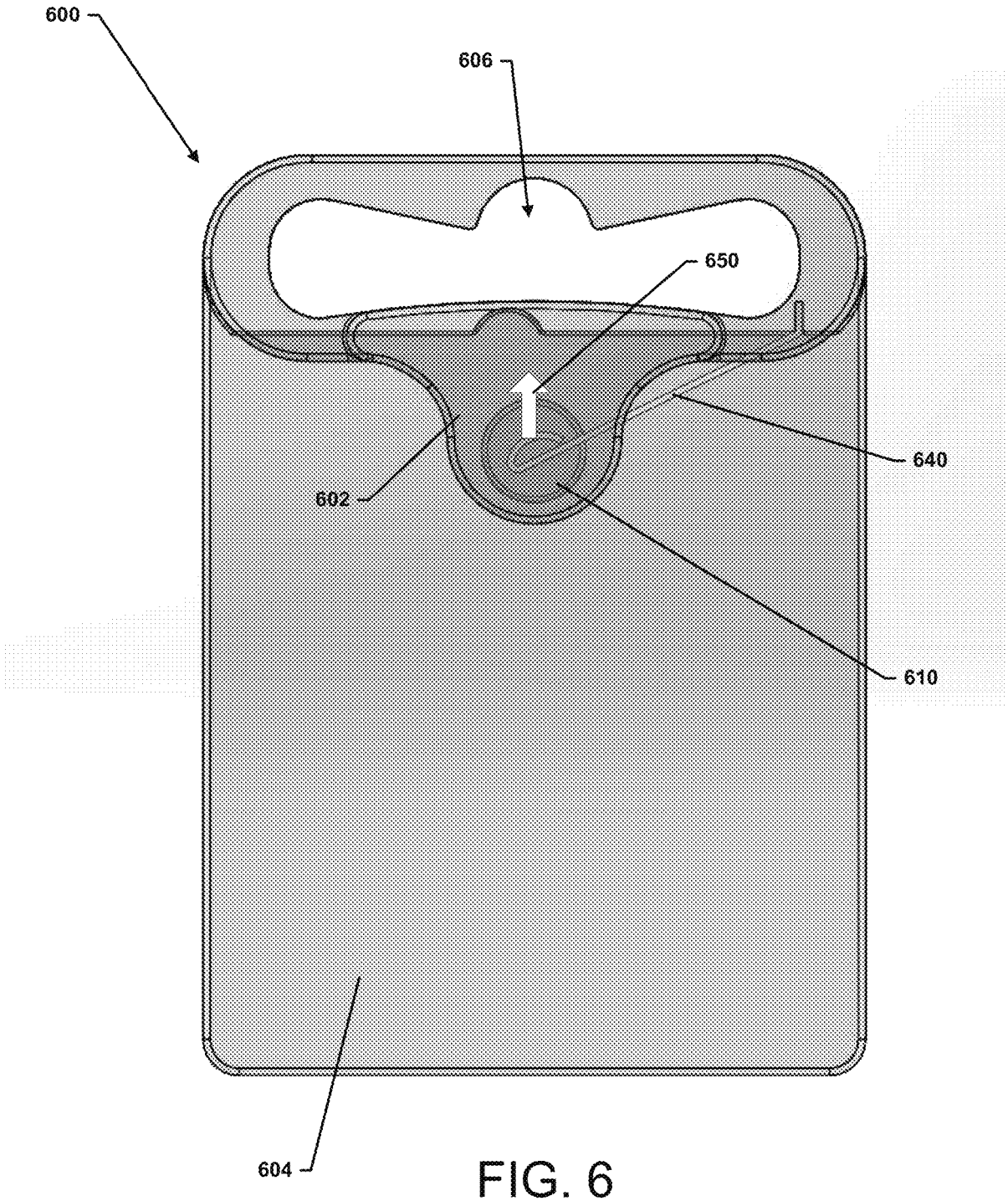
FIG. 6 illustrates a front facing view of a security tag, according to yet another example embodiment.
Figure 7:
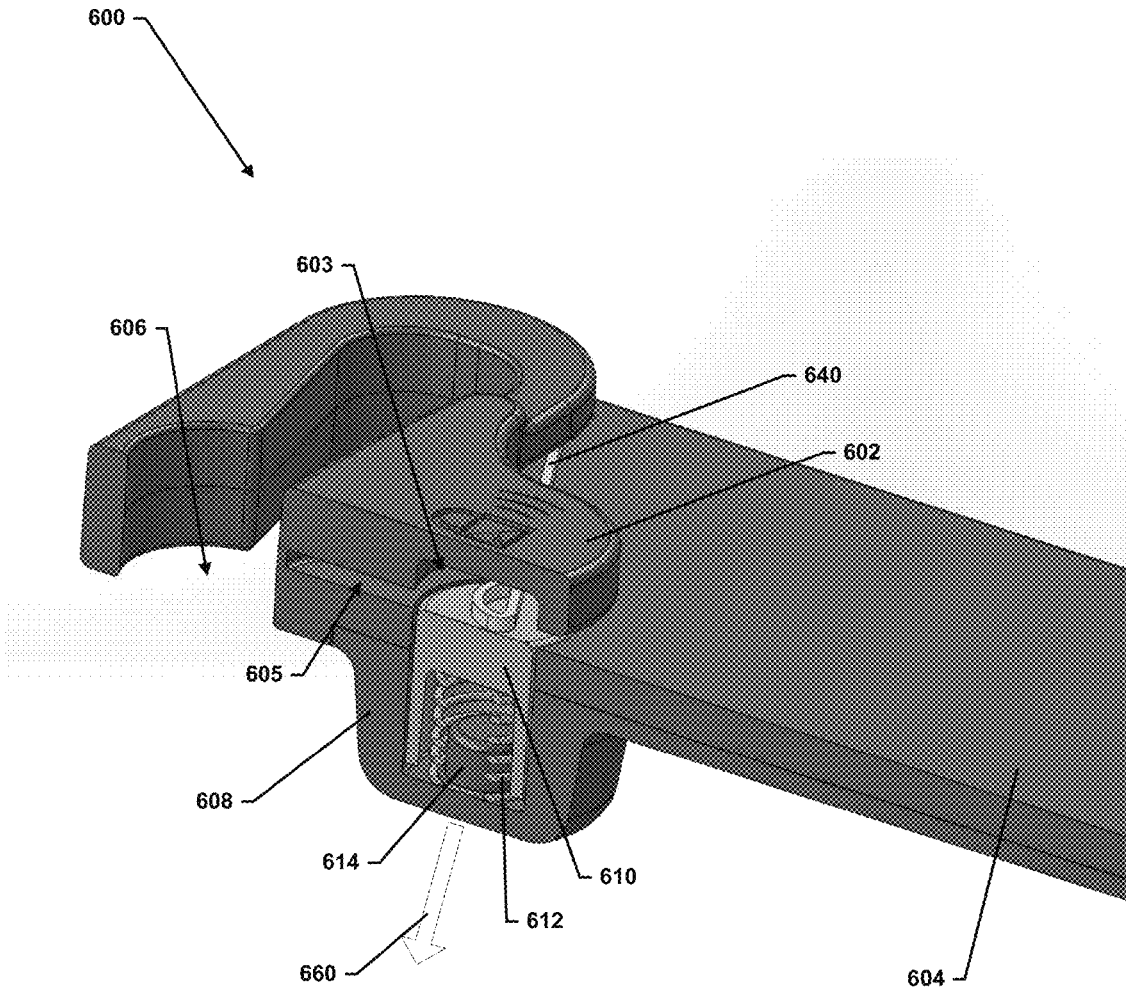
FIG. 7 illustrates a sectional perspective view of the security tag of FIG. 6 in accordance with an example embodiment.

FIGS. 6 and 7 depict a security tag 600 having an aperture 606, pin cover 602, tag housing 604, lock and pin housing 608, pin 610, spring 612, and spring locator 614 similar to the apertures 106/406, pin covers 102/402, tag housings 104/404, lock and pin housings 108/408, pins 110/410, springs 112/412, and spring locators 114/414 described above. However, in the examples of FIGS. 6 and 7, the security tag 600 includes a different lock and pin mechanism. Of note, the pin cover 602 of FIG. 6 is shown as transparent to allow the lock and pin mechanism to be viewed for better explanation. In this regard, in the example of FIGS. 6 and 7, the lock and pin mechanism includes a spring lock 640 for acting as the trigger element relative to the pin 610.

As can be seen in FIGS. 6 and 7, the security tag 600 includes a catch portion receiving gap 605 in which the catch portion 70 of the article 50 may be placed to displace the spring lock 640 (which acts as the trigger element) and free the pin 610. In both FIGS. 6 and 7, the spring lock 640 is positioned to hold the pin 610 in the unlocked state. In this regard, the spring lock 640 is extended over the top surface of the pin 610 to hold the pin 610 within the lock and pin housing 608 and prevent the pin 610 from moving through the catch portion receiving gap 605 into the pin receiver 603 to advance to the locked state. As such, the spring lock 640 holds the pin 610 against a spring force exerted by spring 612 so that the pin 610 is substantially held within the lock and pin housing 608. Although the spring 612 may be provided inside a magnetic spring cup (similar to the examples above), the pin 610 could alternatively act as the spring cup, and may be made of or include a metallic material to allow unlocking with a magnetic key. It should also be appreciated that other embodiments may employ other biasing mechanisms other than a helical compression spring such as spring 612. For example, a torsion spring, wave spring, leaf spring, extension spring, or other biasing member could be configured as a substitute for a compression spring, and conical or barrel configurations could be employed as alternative compression springs to the helical spring shown. Moreover, in some cases, a deflected plastic arm may be provided as, or to incorporate, the biasing member.

As can be appreciated from FIG. 6, the spring lock 640 may be anchored at one end (i.e., a proximal end) to a portion of the security tag 600 and substantially free at the other end (i.e., the distal end). The spring lock 640 may have a rest position that places the distal end over the top surface of the pin 610. The spring lock 640 may be made of a metallic or other rigid, but flexible material that can exert a biasing force to return the spring lock 640 toward the rest position when a force competing against the biasing force is not present. In some embodiments, the spring lock 640 may have a height in a direction substantially perpendicular to a surface of the tag housing 604 that is slightly less than (but nearly equal to) a height of the catch portion receiving gap 605. However, in other cases, the spring lock 640 could include very thin metal (e.g., to reduce cost), and the distal end of the spring lock 640 could be bent in or out of the plane in which the remainder of the spring lock 640 lies. By bending the distal end out of plane, the surface area of the spring lock 640 that is available to engage the article 50 may be increased, even when a thin component is used to embody the spring lock 640.

When a portion of the article 50 (i.e., the catch portion 70) is placed within the catch portion receiving gap 605, and pressed against the distal end of the spring lock 640, the spring lock 640 may be urged in the direction shown by arrow 650. The movement of the spring lock 640 may cause the spring lock 640 to move away from the top surface of pin 610. When the catch portion 70 sufficiently pushes spring away from pin 610, and the orifice 60 is substantially aligned with the pin 610, the spring 612 forces the pin 610 in an upward direction (i.e., towards pin receiver 603) to cause the pin 610 to pass through the orifice 60. While a solid material of article 50 (i.e., the catch portion 70) is within the catch portion receiving gap 605 but the orifice 60 is not aligned with the pin 610, the pin 610 is prevented from entering the pin receiver 603 by the solid material of the article 50. However, when the article 50 moves to align the orifice 60 with the pin 610 while the spring lock 640 is away from the pin 610, the spring 612 pushes the pin 610 into the pin receiver 603 and the security tag 600 is affixed to the article 50.

When the pin 610 is advanced to the locked state (e.g., being advanced to enter into the pin receiver 603), the catch portion 70 cannot be removed and the security tag 600 is fixed to the article 50 until some action is taken to transfer the lock and pin mechanism to the unlocked state. As discussed above, a magnetic key may be placed proximate to the lock and pin housing 608 to draw the pin 610 downward (i.e., in the direction shown by arrow 660). As an alternative, a wireless signal may be used to actuate a solenoid or other electrical actuator to draw the pin 610 downward. When the pin 610 is withdrawn from the pin receiver 603 and clears the catch portion receiving gap 605, the spring lock 640 is enabled to return to the position shown in FIG. 7. In this regard, the spring lock 640 returns to a position in which the distal end of the spring lock 640 prevents the pin 610 from moving into the catch portion receiving gap 605 and the pin receiver 603.

As can be appreciated from the examples described above, in each case, a portion of the article 50 (e.g., the catch portion 70) is moved at least partially in a first direction (i.e., the direction of arrows 430 and 650) to encounter and displace a trigger element. Displacement of the trigger element in some examples also occurs substantially in the first direction to allow the pin to advance from an unlocked state to the locked state by moving in a second direction (i.e., the direction opposite of the direction shown by arrow 660) that is substantially perpendicular to the first direction to retain the portion of the article.

Figure 8A:
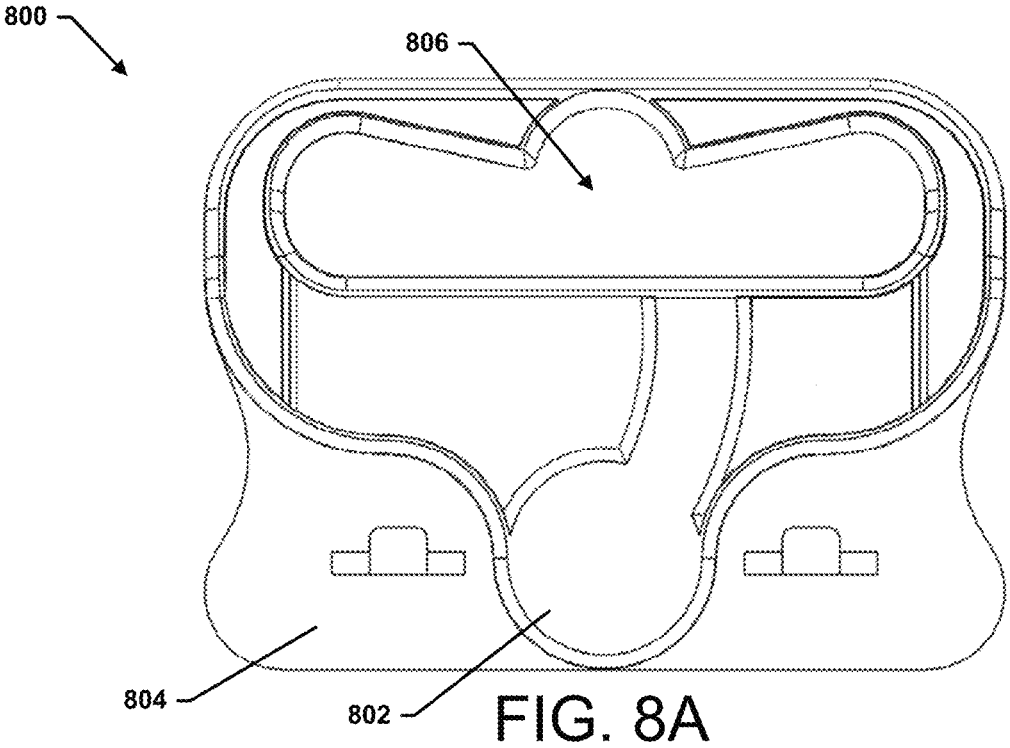
FIG. 8A is front view of an alternative security tag design in accordance with an example embodiment.
Figure 8B:
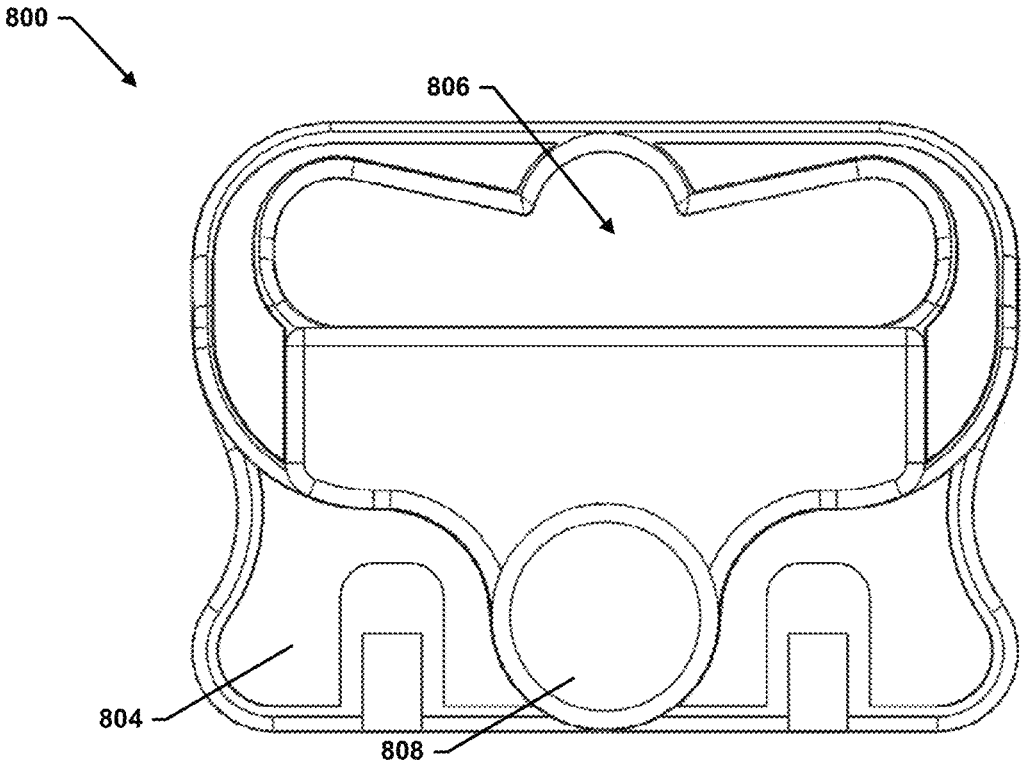
FIG. 8B is back view of the security tag of FIG. 8A in accordance with an example embodiment.

The examples of FIGS. 1-7 above illustrate that the lock and pin mechanism can be embodied a number of different ways, and with corresponding different structures. However, it should also be appreciated that other structural features of security tags of an example embodiment may also be altered in some cases. FIG. 8, which includes FIGS. 8A, 8B, 8C and 8D, shows another example of a security tag 800 in which the structures of various components are slightly modified. FIG. 8A illustrates a front view of the security tag 800 and FIG. 8B illustrates a back view of the security tag 800. FIG. 8C illustrates a side view of the security tag 800 in a locked state, and FIG. 8D illustrates a side view of the security tag 800 in an unlocked state.

Referring now to FIGS. 8A, 8B, 8C and 8D, the security tag 800 may include an aperture 806, pin cover 802, tag housing 804, lock and pin housing 808, and pin 810 similar in function to the apertures 106/406/606, pin covers 102/402/602, tag housings 104/404/604, lock and pin housings 108/408/608, and pins 110/410/610 described above, but with corresponding different structures as shown. In this regard, for example, the tag housing 804 is much smaller than the tag housings tag housings 104/404/604 described above. As a result, the lock and pin housing 808 is also less prominent relative to extending away from the tag housing 804. However, the pin 810 still extends from the pin housing 808 through a catch portion receiving gap 805 toward the pin cover 802 to transition to the locked state. Moreover, the pin 810 is also prevented from extending to the locked state until trigger element 840 is moved away from blocking the pin 810 by contact with the catch portion 70 of the article 50.

Figure 9:
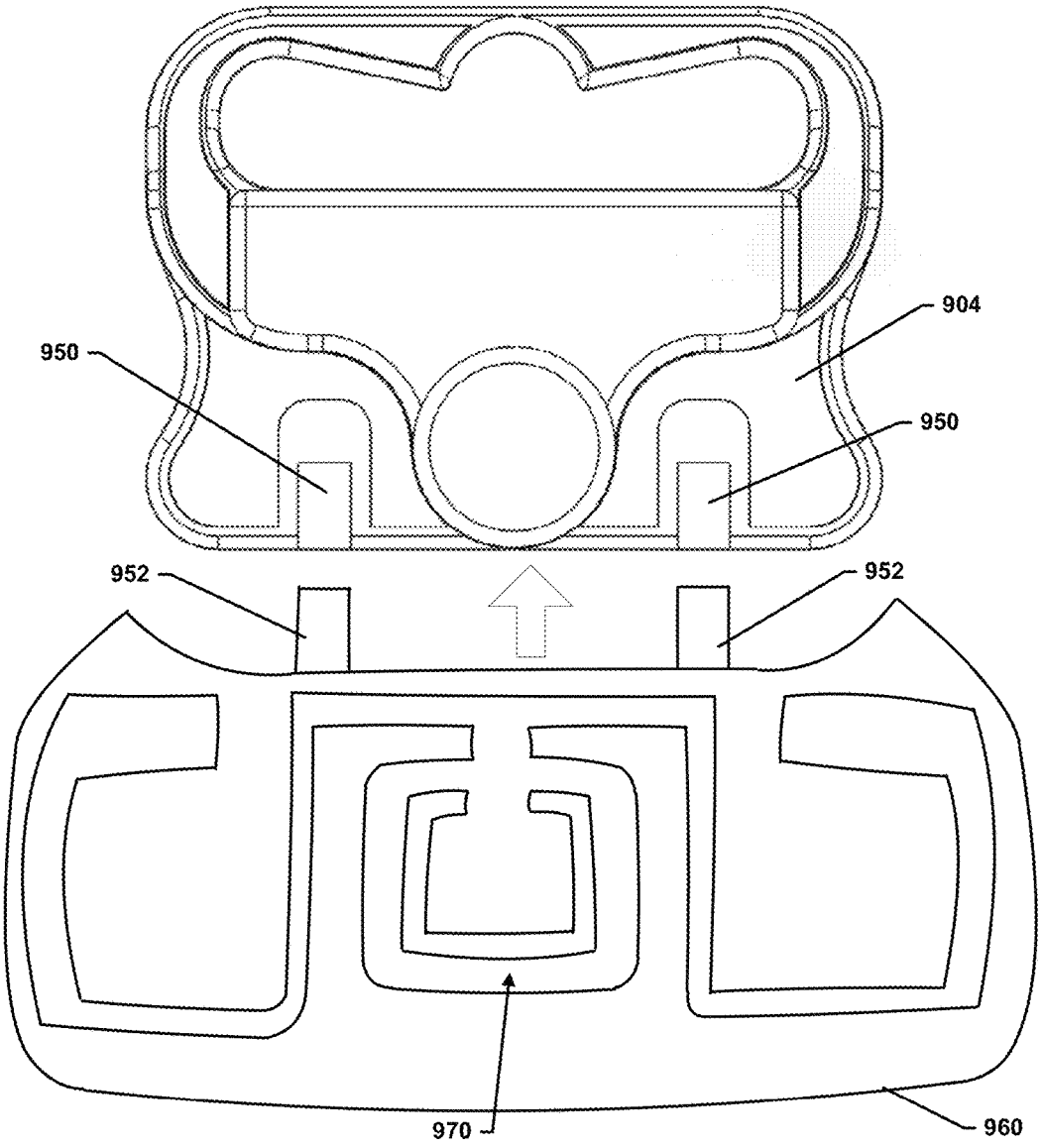
FIG. 9 illustrates a top view of a tag housing with an attachment portion having an information element disposed therein in accordance with an example embodiment.

As mentioned above, the tag housing may sometimes include an attachment mechanism which allows an additional tag housing, including information elements, to be added to the tag housing. FIG. 9 illustrates a tag housing 904 having receiving portions 950 that are configured to receive protrusions 952 extending from attachment portion 960. The attachment portion 960 may house an information element 970 (e.g., an RFID tag).

In an example embodiment, a lock and pin mechanism for transferring a security tag between a locked state in which the security tag is affixed to an article and an unlocked state in which the security tag is not affixed to the article may therefore be provided. The lock and pin mechanism may include a pin and a biasing member. The pin may be substantially retained in a pin housing. The pin may be configured to advance to the locked state by moving toward a pin cover separated from the pin housing by a receiving gap disposed between the pin cover and the pin housing. The pin may be configured to engage the article responsive to placement of the article within the receiving gap. The biasing member may actuate the pin by urging the pin toward the pin cover in response to the article being substantially placed within the receiving gap.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the lock and pin mechanism may include a trigger element that is displaced to enable the biasing member to actuate the pin. In an example embodiment, a portion of the article may be inserted into the receiving gap in a first direction to displace the trigger element in the first direction, and the pin may move in a second direction substantially perpendicular to the first direction to advance toward the pin cover. In some cases, the security tag may be in an unlocked state responsive to the trigger element blocking the pin from moving toward the pin cover, and the security tag may be in a locked state responsive to the trigger element being displaced and the pin being actuated. In an example embodiment, the pin may advance through the receiving gap into a pin receiver disposed at the pin cover in the locked state. In some cases, the trigger element may include a sloped, top surface of the pin. Alternatively, the trigger element may include an actuator biased toward engagement with the pin. The actuator may include a flange configured to engage a retaining edge of the pin to prevent movement of the pin toward the pin cover in an unlocked state, and the flange may disengage the retaining edge responsive to the article displacing the actuator. As another alternative, the trigger element may include a spring lock having a proximal end anchored at a portion of the security tag, and a distal end biased toward a rest position at which the pin is held out of the receiving gap. The pin is enabled to extend toward the pin cover responsive to the spring lock being displaced away from the rest position. In an example embodiment, the biasing member may be retained in a metallic cup, and the security tag may transition from a locked state to an unlocked state responsive to a magnetic key drawing the metallic cup away from the pin cover to withdraw the pin from the receiving gap. In some cases, the security tag may further include a tag housing that has a first surface that extends substantially parallel to a top surface of the pin, and a second surface that extends substantially parallel to the first surface. The pin cover may face the first surface and the pin housing may extend away from the second surface. In an example embodiment, the tag housing may include a recess disposed between the first and second surfaces and the recess may hold an information element therein. In some cases, the information element may include an acousto-magnetic element (AM), a radio frequency element (RF), an electro-magnetic element (EM), or a radio frequency identification (RFID) element. In an example embodiment, the pin may be configured to be transitioned to a locked state based on physical contact with the article, and the pin may be configured to be transitioned to an unlocked state based on operation of a magnetic key or wirelessly triggered unlocking mechanism.

Many modifications and other embodiments set forth herein will come to mind to one skilled in the art to which these embodiments pertain having the benefit of the teachings presented in the foregoing descriptions and the associated drawings. Therefore, it is to be understood that the embodiments covered are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A security tag comprising:

a pin cover;

a pin housing;

a receiving gap disposed between the pin cover and the pin housing;

a pin configured to engage an article placed within the receiving gap;

a biasing member configured to actuate the pin by urging the pin toward the pin cover in response to the article being substantially placed within the receiving gap; and a trigger element, the trigger element being displaced to enable the biasing member to actuate the pin.

2. The security tag of claim 1, wherein a portion of the article is inserted into the receiving gap in a first direction to displace the trigger element in the first direction, and wherein the pin moves in a second direction substantially perpendicular to the first direction to advance toward the pin cover.

3. The security tag of claim 1, wherein the security tag is in an unlocked state responsive to the trigger element blocking the pin from moving toward the pin cover, and wherein the security tag is in a locked state responsive to the trigger element being displaced and the pin being actuated.

4. The security tag of claim 3, wherein the pin advances through the receiving gap into a pin receiver disposed at the pin cover in the locked state.

5. The security tag of claim 1, wherein the trigger element comprises a sloped, top surface of the pin.

6. The security tag of claim 1, wherein the trigger element comprises an actuator biased toward engagement with the pin, the actuator comprising a flange configured to engage a retaining edge of the pin to prevent movement of the pin toward the pin cover in an unlocked state, and wherein the flange disengages the retaining edge responsive to the article displacing the actuator.

7. The security tag of claim 1, wherein the trigger element comprises a spring lock having a proximal end anchored at a portion of the security tag, and a distal end biased toward a rest position at which the pin is held out of the receiving gap, and wherein the pin is enabled to extend toward the pin cover responsive to the spring lock being displaced away from the rest position by engagement with the article.

8. The security tag of claim 1, wherein the biasing member is affixed to a metallic member, and wherein the security tag transitions from a locked state to an unlocked state responsive to a magnetic key drawing the metallic member away from the pin cover to withdraw the pin from the receiving gap.

9. The security tag of claim 1, further comprising a tag housing, the tag housing having a first surface that extends substantially parallel to a top surface of the pin, and a second surface that extends substantially parallel to the first surface, wherein the pin cover faces the first surface and the pin housing extends away from the second surface.

10. The security tag of claim 1, wherein the security tag includes an information element.

11. The security tag of claim 10, wherein the information element comprises an acousto-magnetic element (AM), a radio frequency element (RF), an electro-magnetic element (EM), or a radio frequency identification (RFID) element.

12. The security tag of claim 1, wherein the pin is configured to be transitioned to a locked state based on physical contact with the article, and wherein the pin is configured to be transitioned to an unlocked state based on operation of a magnetic key or wirelessly triggered unlocking mechanism.

13. A lock and pin mechanism for transferring a security tag between a locked state in which the security tag is affixed to an article and an unlocked state in which the security tag is not affixed to the article, wherein the lock and pin mechanism comprises:

a pin substantially retained in a pin housing, the pin being configured to advance to the locked state by moving toward a pin cover separated from the pin housing by a receiving gap disposed between the pin cover and the pin housing, the pin being configured to engage the article responsive to placement of the article within the receiving gap;

a biasing member configured to actuate the pin by urging the pin toward the pin cover in response to the article being substantially placed within the receiving gap; and a trigger element, the trigger element being displaced to enable the biasing member to actuate the pin.

14. The lock and pin mechanism of claim 13, wherein a portion of the article is inserted into the receiving gap in a first direction to displace the trigger element in the first direction, and wherein the pin moves in a second direction substantially perpendicular to the first direction to advance toward the pin cover.

15. The lock and pin mechanism of claim 13, wherein the security tag is in an unlocked state responsive to the trigger element blocking the pin from moving toward the pin cover, and wherein the security tag is in a locked state responsive to the trigger element being displaced and the pin being actuated.

16. The lock and pin mechanism of claim 13, wherein the trigger element comprises a sloped, top surface of the pin.

17. The lock and pin mechanism of claim 13, wherein the trigger element comprises an actuator biased toward engagement with the pin, the actuator comprising a flange configured to engage a retaining edge of the pin to prevent movement of the pin toward the pin cover in an unlocked state, and wherein the flange disengages the retaining edge responsive to the article displacing the actuator.

18. The lock and pin mechanism of claim 13, wherein the trigger element comprises a spring lock having a proximal end anchored at a portion of the security tag, and a distal end biased toward a rest position at which the pin is held out of the receiving gap, and wherein the pin is enabled to extend toward the pin cover responsive to the spring lock being displaced away from the rest position by engagement with the article.

* * * * *